US007651094B1

(12) United States Patent
Hart

(10) Patent No.: US 7,651,094 B1
(45) Date of Patent: Jan. 26, 2010

(54) MULTI-LEVEL BOARD GAME

(76) Inventor: Teal Hart, 2487B Singa St., North Pole, AK (US) 99705

( * ) Notice: Subject to any disclaimer, the term of this patent is extended or adjusted under 35 U.S.C. 154(b) by 0 days.

(21) Appl. No.: 11/903,177

(22) Filed: Sep. 20, 2007

(51) Int. Cl.
*A63F 3/00* (2006.01)

(52) U.S. Cl. ..... 273/241; 273/284; 273/287

(58) Field of Classification Search ..... 273/241, 273/309, 283, 284, 285, 287
See application file for complete search history.

(56) References Cited

U.S. PATENT DOCUMENTS 2,773,690 A * 12/1956 Housley ..... 273/241
3,604,705 A * 9/1971 Hawthorne ..... 273/148 R
3,709,497 A * 1/1973 Barlow ..... 273/282.1
6,349,939 B1 * 2/2002 Tsai ..... 273/108.1
2004/0041344 A1 * 3/2004 Thomson ..... 273/241

* cited by examiner

*Primary Examiner*—Vishu K. Mendiratta
(74) *Attorney, Agent, or Firm*—Suiter Swantz pc llo

(57) ABSTRACT

A multi-level board game comprises a base assembly, a plurality of vertical support assemblies disposed substantially on a top surface of the base assembly, at least one elevated planar surface disposed substantially within a boundary formed by a configuration of the plurality of vertical support assemblies and positioned above the base assembly, a plurality of first tab assemblies, a plurality of second tab assemblies and plurality of elongated members coupled to a top surface of the base assembly and projecting substantially upward from the base assembly. The at least one elevated planar surface further comprises at least one slot formed within a lateral edge the elevated planar surface and each of the first tab assemblies and the second tab assemblies are suitable for insertion into the at least one slot formed within the at least one elevated planar surface.

18 Claims, 9 Drawing Sheets

MULTI-LEVEL BOARD GAME

FIELD OF THE INVENTION

This invention relates generally to board games, and more particularly to a multi-level board game.

BACKGROUND

Board games provide entertainment and challenge for people of all ages. Many players have sought to develop multi-level board games in an attempt to expand the gaming experience and the player's analysis of gaming moves into multi-planar geometries. While efforts to develop such multi-level gaming have proceeded, the resulting products are often embodied in games having highly complex rules, multiple game pieces, and complicated structures which so complicate the game process that any added entertainment value is outweighed by the added difficulty in attempting to carry out a gaming session. Thus, the prior art has been unable to address the need for a multi-player, multi-level game that appropriately balances the need for increased intellectual stimulation and the ability to develop a player's skills of multi-level spatial analysis, against the need to maintain the enjoyment and leisure intended in playing a recreational game.

SUMMARY

Accordingly, the present invention is directed to a multi-level board game. In one embodiment, a multi-level board game comprises a base assembly, a plurality of vertical support assemblies disposed on a top surface of the base assembly, at least one elevated planar surface disposed substantially within a perimeter boundary formed by the configuration of the plurality of vertical support assemblies and positioned above the base assembly, a plurality of tab assemblies and a plurality of posts coupled to a top surface of said base assembly and projecting substantially upward from the base assembly. Each tab assembly is suitable for insertion into a slot formed within the at least one elevated planar surface.

BRIEF DESCRIPTION OF THE DRAWINGS

Objects, features, and advantages of the multi-level board game will become more apparent from the following detailed description of the various embodiments when taken together with the accompanying drawings in which.

DETAILED DESCRIPTION

Figure 1:
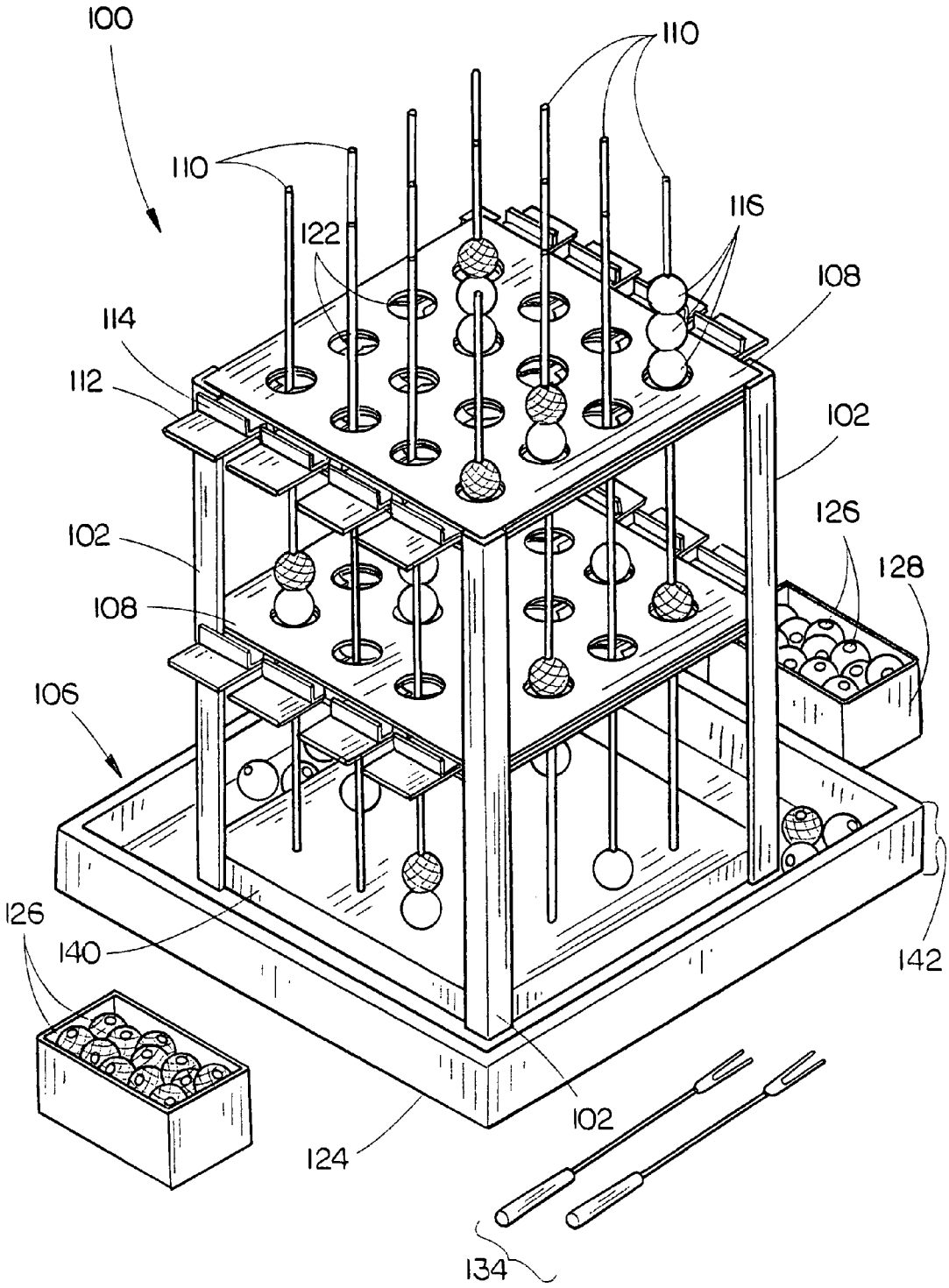
FIG. 1 is an isometric view of an assembled multi-level board game.
Figure 2:
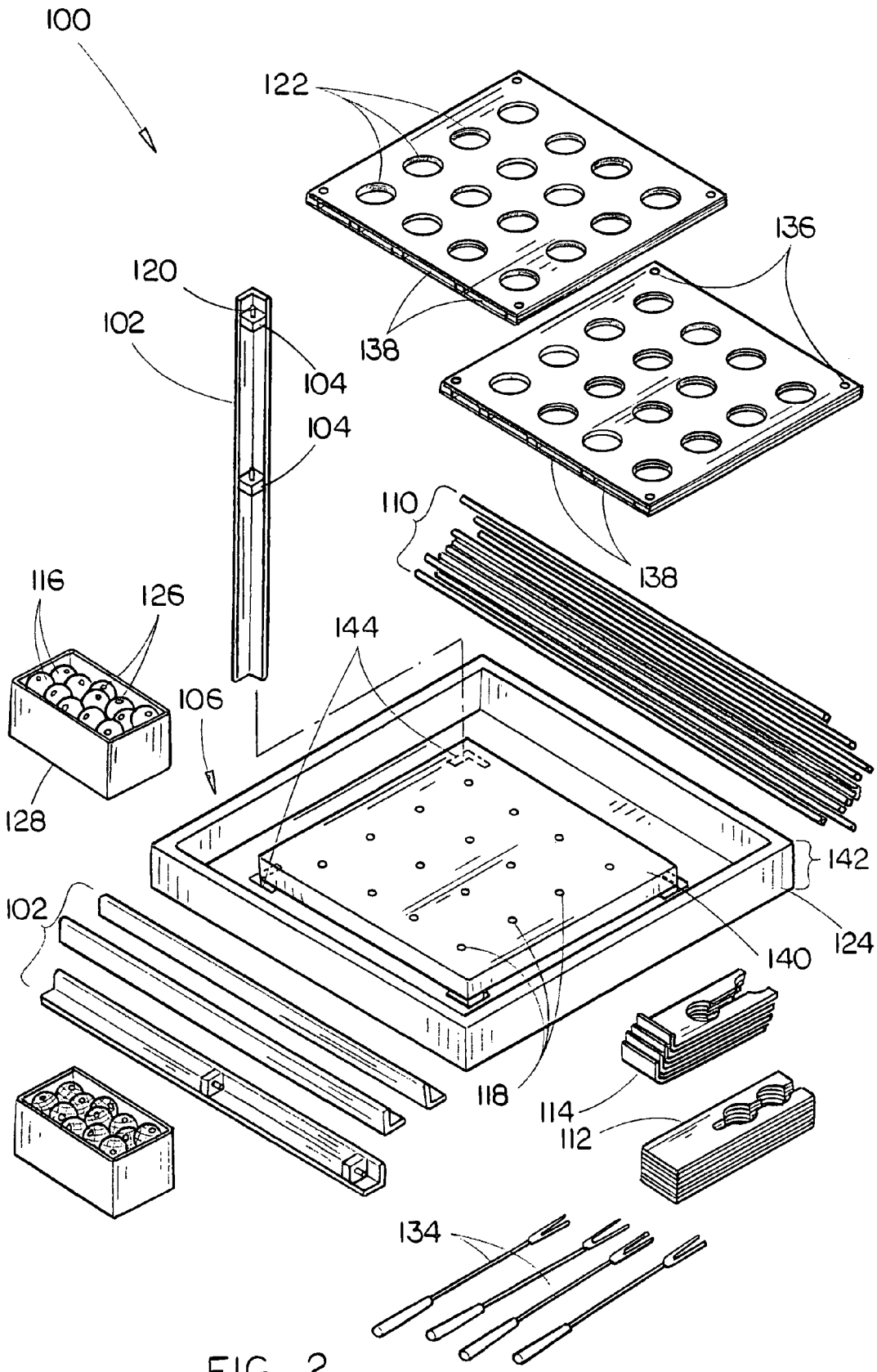
FIG. 2 is an isometric view of the various board game components.
Figure 3:
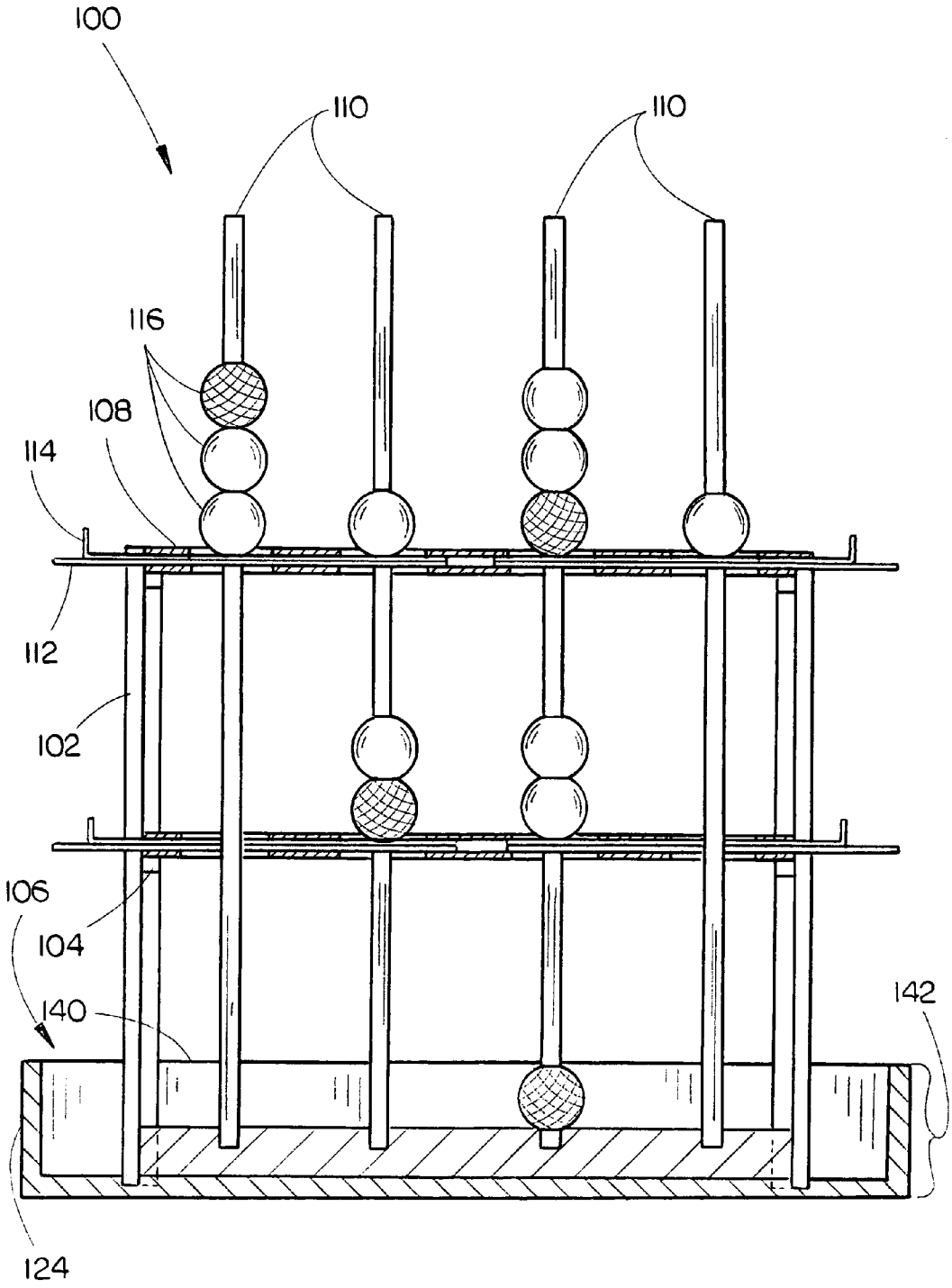
FIG. 3 is a side view of the multi-level board game.
Figure 4:
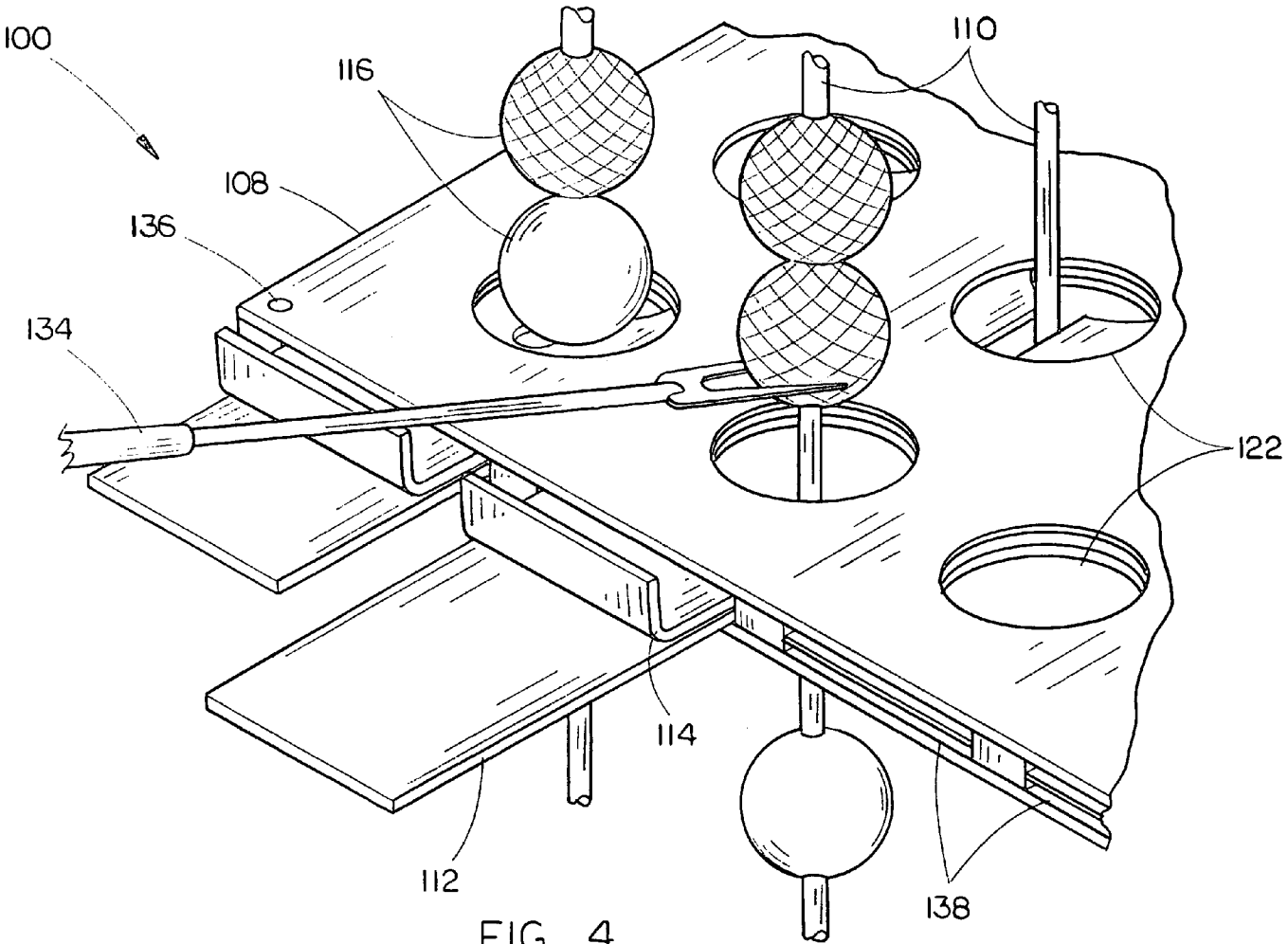
FIG. 4 is an exploded isometric view of the multi-level board game depicting game pieces supported by the lifting assembly.

Referring to FIGS. 1 and 2, isometric views of the multi-level board game 100 are shown. FIG. 1 is an isometric view of an assembled multi-level board game 100, and FIG. 2 is an isometric view of the various board game 100 components. In one embodiment, the multi-level board game 100 comprises a plurality of vertical support assemblies 102, a base assembly 106, at least one elevated planar surface 108, a plurality of first tab assemblies 112, a plurality of second tab assemblies 114 and a plurality of posts 110. Each of the plurality of vertical support assemblies 102 is disposed on a top surface of the base assembly. The at least one elevated planar surface 108 is disposed substantially within a perimeter boundary formed by the configuration of the plurality of vertical support assemblies 102 and is positioned above the base assembly 106. Each of the first and second tab assemblies 112, 114 is suitable for insertion into a slot formed within the at least one elevated planar surface. Each of the plurality of posts 110 are coupled to a top surface of the base assembly 106 and project substantially upward from the base assembly 106.

Accordingly, the various embodiments of the multi-level board game 100 comprise a base assembly 106 and a plurality of vertical support assemblies 102. Referring specifically to FIG. 1, in the preferred embodiment, base assembly 106 may comprise a base assembly platform 140. Base assembly 106 may also comprise a shallow container 124 having a top surface onto which the elevated platform is coupled. Base assembly container 124 may comprise a raised ledge 142 or ridge to prevent game pieces 116 from rolling beyond the boundaries of the multi-level board game 100 Base assembly elevated platform 140 may comprise a plurality of apertures 118 each suitable for receiving a post 110. Base assembly container 124 may comprise a plurality of slots 144 suitable for receiving a vertical support assembly 102. In an additional embodiment (not shown), the base assembly 106 may be a platform comprising a plurality of first apertures through which a vertical support assembly 102 may be inserted and a plurality of second apertures through which a vertical elongated member 110 may be inserted.

Vertical support assemblies 102 may be v-shaped or L-shaped supports. Vertical support assemblies 102 may be positioned substantially in the corners of the base assembly 106. To this end, as described, base assembly container 124 may comprise a plurality of slots or apertures 144 disposed substantially about the perimeter of the base assembly platform 140 suitable for receiving the vertical support assemblies 102. Vertical support assemblies 102 may each be provided with a plurality of protrusions or ledges 104 coupled horizontally to at least one interior surface of a vertical support assembly 102. Each ledge 104 may be configured to fit substantially within an interior region of the vertical support assemblies 102 at any position along the length of the vertical support assembly 102. In this manner, horizontal planar surface height relative to the base assembly 106 and top horizontal planar surface 108 may be adjustable.

Horizontal planar surfaces 108 may be disposed within the vertical support assemblies 102 and may be secured to at least one vertical support assembly 102 by use of any fastening means, including, but not limited to screws, posts, nut and bolt assemblies, nails, hook and loop material, or adhesives, or may be held in place through frictional resistance. Each of the horizontal planar surfaces 108 may be formed from wood, metal, plastic or any durable material suitable for forming substantially flat horizontal surfaces comprising a plurality of apertures 122 and durability of construction.

In a preferred embodiment, multi-level board game 100 may comprise 4 vertical support assemblies 102, each coupled to a base assembly 106 in a corner or outer perimeter region of the base assembly 106. In this embodiment, multi-level board game horizontal planar surfaces 108 may be substantially rectangular or square. In additional embodiments, multi-level board game 100 may be triangular, circular, oblong, trapezoidal, or any other shape, and may comprise corresponding horizontal planar surfaces 108. Likewise, vertical support assemblies 102 may conform as needed to the shape of the base assembly 106 or any other component of the multi-level board game 100.

As mentioned, multi-level board game 100 100 also comprises at least one horizontal planar surface 108. A horizontal planar surface 108 may be further defined as a first horizontal planar surface and a second horizontal planar surface. The first horizontal planar surface is positioned above and parallel to the second horizontal planar surface, which is positioned substantially between the first horizontal planar surface and the base assembly 106. Each horizontal planar surface 108 is configured to be a board game level, and may also be configured in generally the same shape as the base assembly 106. A region of each horizontal planar surface 108 may rest on a ledge 104 of a vertical support assembly 102 or be otherwise coupled to the vertical support assembly 102. In the fully assembled configuration shown in FIG. 1, a single vertical support assembly 102 is preferably positioned in a region corresponding with a corner of each horizontal planar surface 108. In one embodiment, a single corner of each horizontal planar surface 108 engages a single vertical support assembly 102 at a ledge 104, such that the four vertical support assemblies 102 support each of the four corners of a single horizontal planar surface 108 along a generally horizontal plane. Ledges 104 of each vertical support assembly 102 are positioned a sufficient vertical distance from one another to allow multiple horizontal planar surfaces 108 to be positioned within the perimeter formed by the vertical support assemblies as distances providing adequate space between the base assembly 106 and the plurality of horizontal planar surfaces 108. Ledges 104 may be provided with a mechanism 120 to securely yet releasably hold each corner of a horizontal planar surface 108 in place during game play. Additionally, a highest level top planar surface 108 may fit substantially over vertical support assemblies 102. To this end, horizontal planar surface 108 may comprise slots or openings suitable for receiving the top portions of the vertical support assemblies 102.

Figure 6:
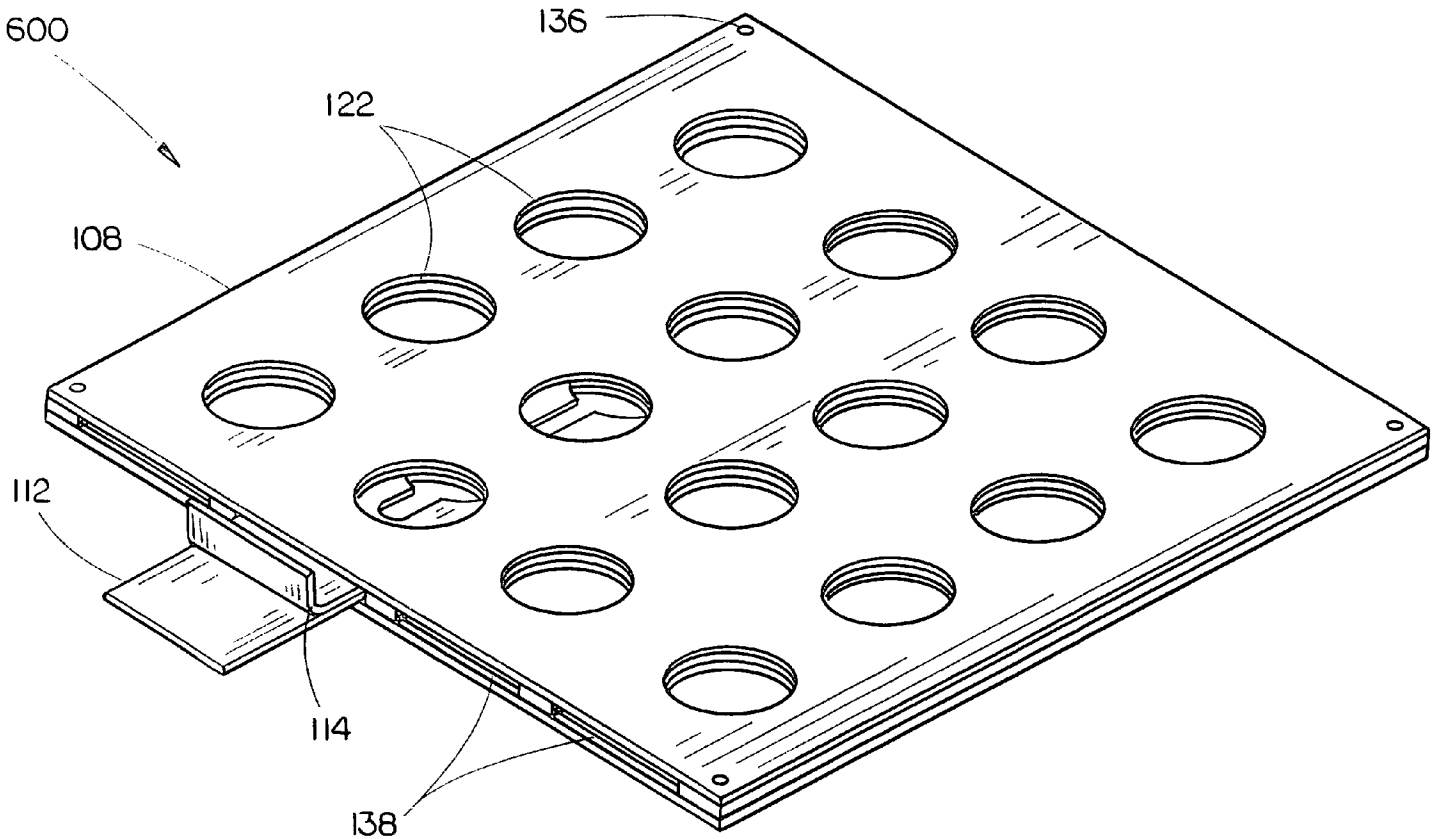
FIG. 6 is an isometric view of one level of the multi-level board game comprising first and second tab assemblies.
Figure 7:
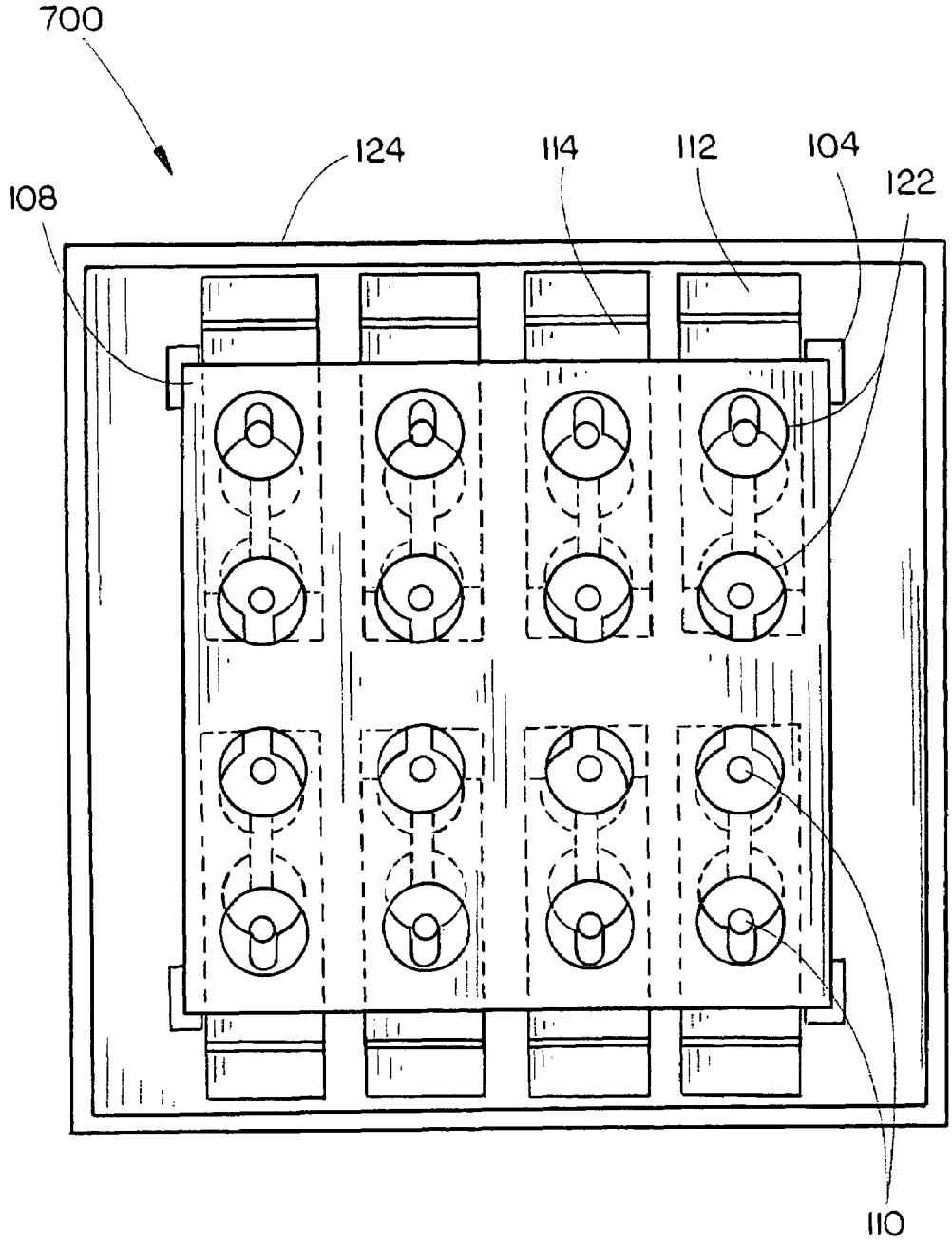
FIG. 7 is an top view of one level of the multi-level board game.
Figure 8:
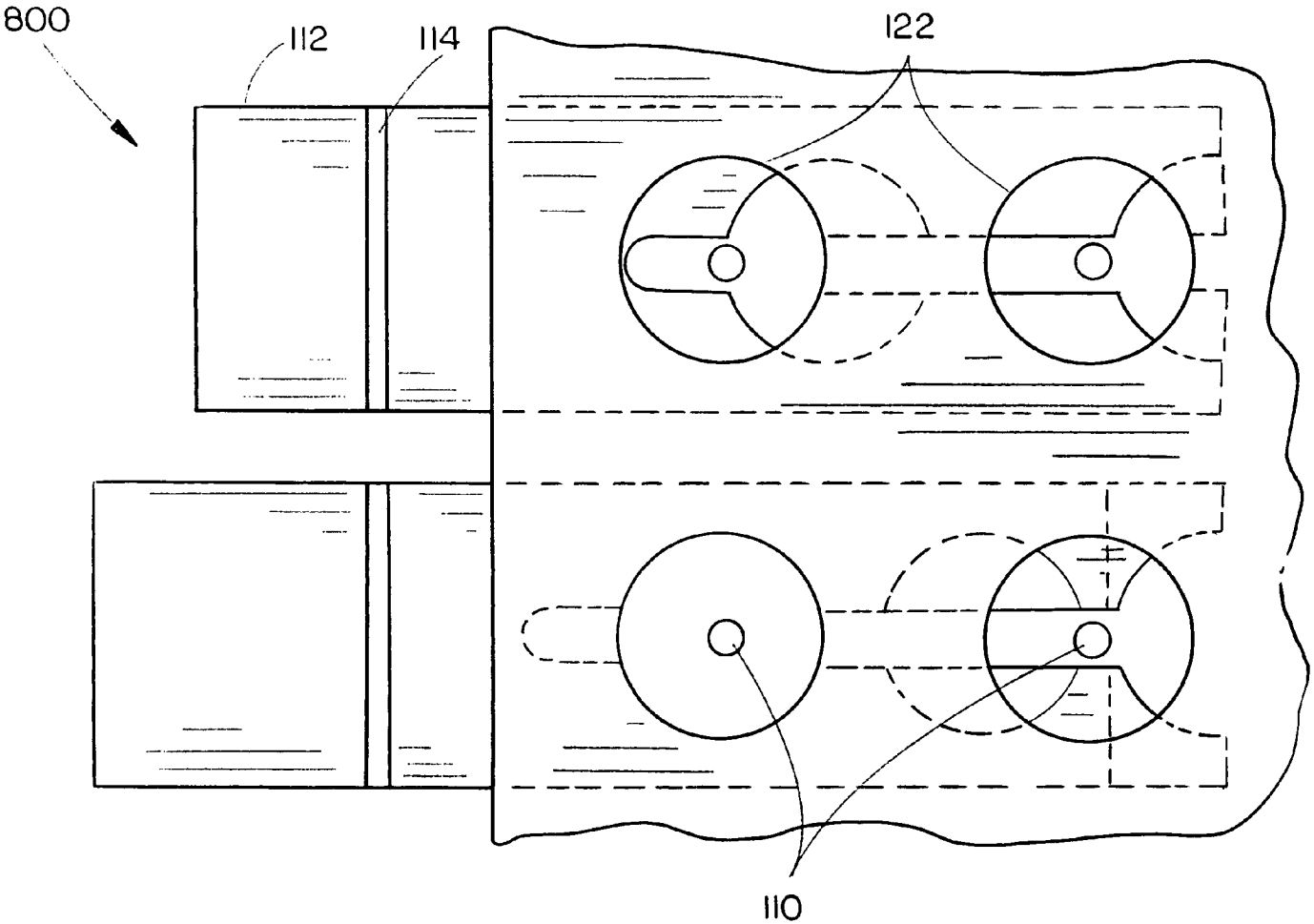
FIG. 8 is an exploded top view of one level of the multi-level board game.

Each of the plurality of horizontal planar surfaces 108 may comprise at least one lateral edge having thickness of at least ½ cm. Referring specifically to FIG. 6, lateral edge may comprise at least one opening such as a slot 138 suitable for receiving a first tab assembly 112 and a second tab assembly 114. First and second tab assemblies 112, 114 may be independently slideable within the slot 138, such that a first tab assembly 112 may slide into or out of the slot 138 independently of the second tab assembly 114 and second tab assembly 114 may slid independently of the first tab assembly 112. First and second tabs 112, 114 may slide also together by grasping both tab assemblies 112, 114. In an additional embodiment, a single tab assembly comprising at least two apertures may be utilized. The single tab assembly may be insertable into the slot 138 and be formed of two slidably coupled independently moveable tabs. In a further additional embodiment, a single tab may provide opening and closing of a single aperture 122. In this embodiment, slots 138 may be disposed substantially about the entire perimeter or circumference of the horizontal planar surface 108 such that a single tab comprising one opening is inserted into each slot 138. Additionally, each horizontal planar surface 108 may comprise a plurality of coupling apertures 136 suitable for coupling a horizontal planar surface 108 to a vertical support assembly 102. Coupling aperture may releasably engage with a ledge projection 120 suitable for fitting within the coupling aperture 136.

Figure 5:
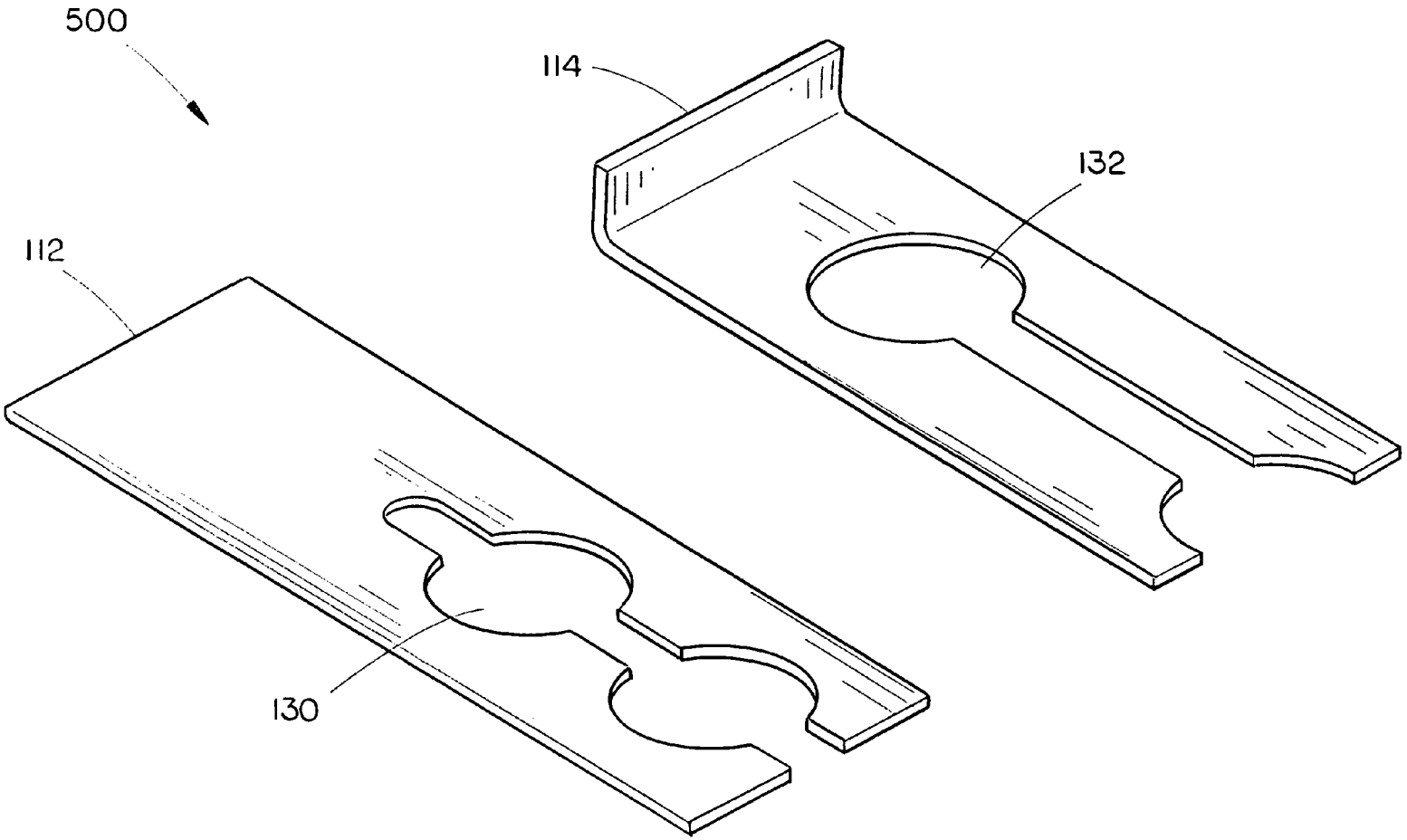
FIG. 5 is an isometric view of the first and second tab assemblies of the multi-level board game.

Referring to FIG. 5, an isometric view 500 of the first and second tab assemblies 112, 114 of the multi-level board game 100 is shown. First tab assembly 112 may comprise be formed with a first tab assembly aperture assembly 130. First tab assembly aperture assembly 130 may comprise at least two apertures each large enough to allow a game piece 116 to fall therethrough. Second tab assembly 114 may comprise be formed with a second tab assembly aperture assembly 132. Second tab assembly aperture assembly 132 may comprise at least one aperture large enough to allow a game piece 116 to fall therethrough. When substantially slid into a slot 138, first tab assembly 112 may provide a stop for at least two apertures 122 of a horizontal planar surface 108. Likewise, when substantially slid into a slot 138, second tab assembly 114 may also provide a stop for at least two apertures 122. Sliding of either a first tab assembly 112 or a second tab assembly 114 in an outward direction, i.e., pulling a tab assembly 112, 114 away from the horizontal planar surface, may open an aperture 122 to allow at least one game piece to fall therethrough.

Multi-level board game 100 may also comprise a plurality of game pieces 116. Game pieces 116 may be a plurality of colors, shapes, or sizes. For instance, game pieces 116 may be dividable into sets comprising one color, shape or size. It is contemplated that a player may utilize one set of game pieces 116 comprising all one color, shape or size. Game pieces may be collected in a game piece container 128 to facilitate separation of game pieces 116 into game pieces of a single color, shape or size. Game pieces 116 may further comprise a substantially centrally located game piece aperture 126. Game piece aperture 126 may be large enough to allow a post 110 of the multi-level board game 100 to be inserted therethrough. Game piece aperture 126 may allow a game piece 116 to slide along post 110 until stopped by a first or second tab assembly 112, 114, or a top surface of the base assembly 106.

Base assembly 106 comprises a plurality of apertures 118 each suitable for receiving a vertical elongated member 110 such as a post, dowel, pole or like elongated members. Vertical elongated members 110 are suitable for insertion into the plurality of apertures 118 formed on the top surface of the base assembly 106. Vertical elongated members 110 may extend substantially upward through the plurality of apertures 122 formed in the horizontal planar surfaces 108.

As shown, each of the plurality of horizontal planar surfaces 108 comprises a plurality of apertures 122 suitable for insertion therethrough of a post 110. Apertures 122 are also large enough to allow a game piece 116 to therethrough, and therefore are of a larger circumference or perimeter than the posts.

To lift or hold one or more game pieces 116 in place during play, a lifting assembly 134 is provided. A player may utilize the lifting assembly 134 for supporting one or more game pieces 116 to execute movement of a first tab assembly 112 or second tab assembly 114, allowing only a desired number of game pieces 116 to fall to a lower level. The lifting assembly 134 may comprise two tines coupled to an elongated member, at least a portion of which may be suitable for insertion underneath a game piece 116. The portion of the lifting assembly 134 where the two tines are joined may provide a stop, thereby preventing the lifting assembly 134 from sliding beyond the post. Lifting assembly 134 may be formed of wood, metal, plastic, or any other synthetic or natural material.

Figure 9:
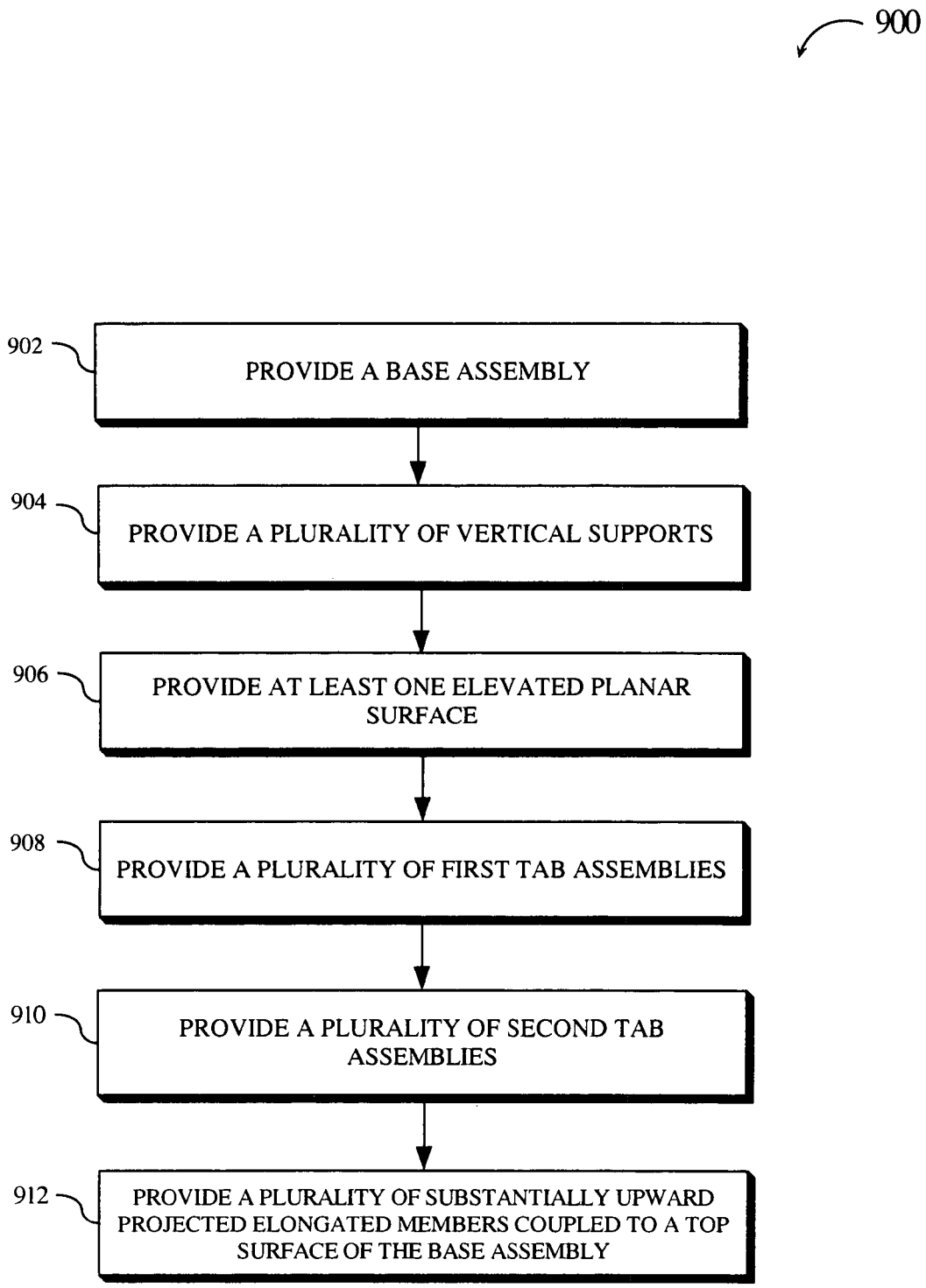
FIG. 9 is a flow diagram illustrating a method for manufacturing a multi-level board game.

Referring to FIG. 9, a flow diagram illustrating a method 900 for providing a multi-level board game is shown. Method 900 for manufacturing a multi-level board game comprises providing a base assembly 902. Method 900 also comprises providing a plurality of vertical support assemblies 904 suitable for coupling to said base assembly and providing at least one elevated planar surface 906 suitable for positioning above said base assembly within a boundary formed by a configuration of said plurality of vertical support assemblies. Method 900 also comprises providing a plurality of first tab assemblies 908, each suitable for insertion into a slot formed within the at least one elevated planar surface and providing a plurality of second tab assemblies 910, each suitable for insertion into a slot formed within the at least one elevated planar surface. Method 900 may also comprise providing a plurality of elongated members coupled to a top surface of the base assembly and projecting substantially upward from the base assembly 912. Method 900 may further comprise providing each of the elevated planar surfaces with a plurality of apertures. Each of the plurality of elongated members is suitable for extending through each of the plurality of elevated planar surface apertures. Method 900 may also comprise providing a plurality of game pieces.

While the preferred embodiment of the multi-level board game 100, as shown in FIG. 1, comprises a base assembly 106 and two horizontal planar surfaces 108, it should be noted that additional horizontal planar surfaces 108 as well as additional rows or columns of apertures 122 in a single horizontal planar surface 108 may be added to increase the level of challenge and complexity involved in game play, and may likewise be removed to decrease the level of challenge and complexity, without departing from the spirit and scope of the instant invention. Corresponding tab assemblies 112, 114, vertical elongated members 110, and game pieces 116 may also be added. Additional horizontal planar surfaces 108 may be disposed within the vertical support assemblies 102, which may be extendable to accommodate additional levels of horizontal planar surfaces 108.

As stated, multi-level board game 100 is suitable for multiple skill levels. For instance, beginner players may utilize only a top horizontal planar assembly 108 and base assembly 106. First and second tab assemblies 112, 114 and lifting assemblies 134 may or may not be utilized. A first player slides a game piece 116 down a selected post 110 by positioning the game piece 116 over the post 110 such that the post 110 is inserted through the centrally located aperture 126 of the game piece 116. Play alternates in this same manner, until a player places four game pieces 116 of the same color in a row either up and down, across, or diagonally.

The object of the game of the instant invention is for a player to align a specific number of same colored, shaped or otherwise designated game pieces 116 in a row before every other player. In the preferred embodiment, a player may be required to align 4 game pieces 116. Play typically begins on the top horizontal planar surface 108, however, a win may occur on any level. As play continues, a first player may drop one, two, three, four or more game pieces 116 to the middle horizontal planar surface 108. A player may utilize the lifting assembly 134 to hold in place any game pieces 116 desired to remain on an upper or lower horizontal planar surface 108. With the lifting assembly 134 in place, a first player may slide the first tab assembly 112 out until the game pieces 116 drop to a lower horizontal planar surface 108. The first tab assembly 112 may be slid back into a position, such as an original position, preventing any additional game pieces 116 from dropping to a lower horizontal planar surface 108, and the lifting assembly 134 may be utilized to set game piece or pieces 116 down.

In additional embodiments, a player must declare "one move," indicating that the player is one move away from a win. "One move" may be declared after the player has dropped a game piece 116. A second player may then attempt to block the first player from winning by placing a game piece 116 in the path of the first player.

A more advanced level of play may comprise the same rules as described above, except players may be playing at least three levels including a base assembly 106 level and at least two horizontal planar surface 108 levels. If a player chooses to drop a game piece 116 from the top horizontal planar surface, he may choose to drop the game pieces 116 down to the middle horizontal planar surface or to the lower horizontal planar surface on the same turn. In order to drop the game pieces 116 to the lower level from the top level, there must be no game pieces 116 in that section of the middle horizontal planar surface. The player would then align both tab assemblies 112 or 114 of both upper and middle planar surfaces 108 respectively to allow the game pieces 116 to drop to a lower planar surface 108 or base assembly 106.

If more than two players are playing and "one move" is declared by a first player, a second player may choose to block the first player, or leave the block for a third player or a fourth player. "One move" must be declared any time a player is just one move away from a potential win, regardless of how many "one move's" have been declared previously in that turn. If a first player fails to declare "one move" when "one move" exists, a next player may declare "one move" on his next move, provided "one move" still exists. If a first player does not declare "one move" and then achieves a "four-in-a-row" on the first player's next turn (this is not a win), the next player (on the next player's turn) may catch the "four-in-a-row" and have a second turn. If the "four-in-a-row" remains in place when play returns to the first player, the first player may call "one move" at that time. If the "four-in-a-row" remains until play gets back to the first player, the first player would be declared the winner.

As stated, for even more advanced play, additional horizontal planar surfaces, vertical elongated members, vertical support assemblies, and tab assemblies may be utilized to construct additional board game 100 levels.

It is understood that the specific order or hierarchy of steps in the foregoing disclosed methods are examples of exemplary approaches. Based upon design preferences, it is understood that the specific order or hierarchy of steps in the method may be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in size, materials, shape, form, function, manner of operation, assembly and use of the components thereof without departing from the scope and spirit of the invention or without sacrificing all of its material advantages. The form herein before described being merely an explanatory embodiment thereof. Further, it is contemplated that the specific order or hierarchy of steps in the method can be rearranged while remaining within the scope and spirit of the present invention. It is the intention of the following claims to encompass and include such changes.

What is claimed:

1. A multi-level board game comprising:

a base platform, said base platform having a substantially flat bottom surface;

a plurality of vertically aligned support assemblies engaged with said base platform at one or more locations about the perimeter of said base platform by connection of each of said plurality of vertically aligned support assemblies to said base platform;

an elevated board game level horizontally disposed substantially within a boundary formed by the engagement of said base platform and said plurality of vertically aligned support assemblies and positioned at a height above the base platform sufficient to provide an amount of space between said base platform and said elevated board game level above said base platform, said elevated board game level connected to at least one of said plurality of vertically aligned support assemblies and further comprising a plurality of board game level apertures and at least one horizontally aligned slot formed within a lateral edge of said elevated board game level;

a plurality of first substantially flat tab assemblies inserted into said at least one horizontally aligned slot formed within said elevated board game level;

a plurality of second substantially flat tab assemblies inserted into said at least one horizontally aligned slot formed within said elevated board game level; and a plurality of elongated members coupled to a top surface of said base platform and projecting substantially upward from said base platform.

2. The multi-level board game of claim 1, wherein each of said first substantially flat tab assembly comprises at least one tab assembly aperture.

3. The multi-level board game of claim 1, wherein each of said second substantially flat tab assembly comprises at least two tab assembly apertures.

4. The multi-level board game of claim 1, wherein each of said plurality of vertical support assemblies comprises at least one horizontal support assembly.

5. The multi-level board game of claim 1, further comprising a plurality of game pieces having a surface area less than the diameter of each of the plurality of board game level apertures.

6. The multi-level board game of claim 5, further comprising at least one lifting assembly further including two tines coupled to an elongated member.

7. The multi-level board game of claim 5, wherein each of said plurality of game pieces comprise a substantially centrally positioned diametrically extending aperture.

8. The multi-level board game of claim 7, wherein each of said plurality of game pieces comprising said substantially centrally positioned diametrically extending aperture, upon insertion slides along each of said plurality of elongated members.

9. The multi-level board game of claim 1, wherein said elevated board game level comprises a plurality of elevated board game level apertures.

10. The multi-level board game of claim 9, wherein said each of said plurality of elongated members extends through each of said plurality of elevated board game level apertures.

11. A multi-level board game comprising:

a plurality of vertically aligned support assemblies;

a base platform, said base platform having a substantially flat bottom surface, said base platform engaged with said plurality of vertically aligned support assemblies by connection of each of said plurality of vertically aligned support assemblies to said base platform at one or more locations about the perimeter of said base platform;

a board game level disposed substantially within a boundary formed by a configuration of said plurality of vertical support assemblies positioned at one or more locations about the perimeter of said base platform and secured to at least one of said plurality of vertically aligned support assemblies, said board game level being positioned parallel to and at a height above the base platform sufficient to provide an amount of space between the base platform and the board game level and further including:

a plurality of slots formed with a lateral edge of the board game level; and a plurality of board game level apertures;

a plurality of first substantially flat tab assemblies including at least two tab apertures, each inserted into one of the plurality of slots formed within the lateral edge of said board game level;

a plurality of second substantially flat tab assemblies including at least one tab aperture each suitable for inserted into one of the plurality of slots formed within the lateral edge of said board game level;

a plurality of elongated members coupled to a top surface of said base assembly and projecting substantially upward from said base assembly through said board game level apertures of said board game level; and a plurality of game pieces.

12. The multi-level board game of claim 11, wherein each of said plurality of game pieces comprises a substantially centrally positioned diametrically extending aperture.

13. The multi-level board game of claim 11, wherein each of said plurality of game pieces comprising said substantially centrally positioned diametrically extending aperture, upon insertion, slides along each of said plurality of elongated members.

14. A multi-level board game kit comprising:

a plurality of vertically aligned support assemblies;

a base platform, the base platform having a substantially flat bottom surface suitable for resting on a surface;

a first board game level further including:

a plurality of slots formed with a lateral edge of the first board game level;

and a plurality of first board game level apertures;

a second board game level further including:

a plurality of slots formed with a lateral edge of the second board game level;

and a plurality of second board game level apertures;

a plurality of first substantially flat tab assemblies including at least two tab apertures, each suitable for insertion into one of the plurality of slots formed within the lateral edge of the first board game level or the second board game level;

a plurality of second substantially flat tab assemblies including at least one tab each suitable for insertion into one of the plurality of slots formed within the lateral edge of the first board game level or the second board game level;

a plurality of elongated members; and a plurality of game pieces.

15. The multi-level board game kit of claim 14, further comprising at least one lifting assembly further including two tines coupled to an elongated member.

16. The multi-level board game kit of claim 14, wherein each of the plurality of game pieces comprise a substantially centrally positioned diametrically extending aperture.

17. The multi-level board game kit of claim 14, wherein the first substantially flat tab assembly comprises at least one tab assembly aperture.

18. The multi-level board game kit of claim 14, wherein the second substantially flat tab assembly comprises at least two tab assembly apertures.

* * * * *